US006983763B2

(12) United States Patent
Benckert et al.

(10) Patent No.: US 6,983,763 B2
(45) Date of Patent: Jan. 10, 2006

(54) TELESCOPING BOOM WITH MOVING FLEXIBLE 180° BEND

(75) Inventors: Hartmut Benckert, Filderstadt (DE); Hans Renz, Filderstadt (DE)

(73) Assignee: Putzmeister Aktiengesellschaft, (DE)

( * ) Notice: Subject to any disclaimer, the term of this patent is extended or adjusted under 35 U.S.C. 154(b) by 0 days.

(21) Appl. No.: 10/471,645

(22) PCT Filed: Feb. 28, 2002

(86) PCT No.: PCT/EP02/02161

§ 371 (c)(1),
(2), (4) Date: Sep. 12, 2003

(87) PCT Pub. No.: WO02/072978

PCT Pub. Date: Sep. 19, 2002

(65) Prior Publication Data

US 2004/0148814 A1 Aug. 5, 2004

(30) Foreign Application Priority Data

Mar. 12, 2001 (DE) ..... 101 12 086

(51) Int. Cl.
*E04G 21/04* (2006.01)

(52) U.S. Cl. ..... 137/615; 141/387

(58) Field of Classification Search ..... 137/615; 141/387

See application file for complete search history.

(56) References Cited

U.S. PATENT DOCUMENTS 5,913,323 A * 6/1999 Hudelmaier ..... 137/615
6,679,284 B1 * 1/2004 Raymond ..... 137/615

* cited by examiner

*Primary Examiner*—Kevin Lee
(74) *Attorney, Agent, or Firm*—Pendorf & Cutliff

(57) ABSTRACT

The invention relates to a distributor device for thick matter, especially for concrete. The distributor device (16) comprises a concrete distributing boom (18) carrying a conveying conduit (20), which has at least two boom arms (30 to 36) that can be swiveled about horizontal articulation axes (38 to 44) relative to one another or relative to a boom support (26). At least one of the boom arms, preferably the base arm (30), is telescopically movable. In order to be adaptable to the telescoping movements, the conveying conduit is assembled from three interlinked conduit sections in the area of the telescoping boom arm. A first conduit section (58) is rigidly linked with the stationary member (46), while a second conduit section (60) is rigidly linked with the extensible telescoping member (48). The device further comprises an intermediate section (62) which is connected with its ends (64, 66) to the first and the second conduit section (58, 60) and which is configured as a flexible pipe. Said pipe has a 180° arch (70) with constant bend that travels when the boom arm telescopes.

14 Claims, 2 Drawing Sheets

TELESCOPING BOOM WITH MOVING FLEXIBLE 180° BEND

CROSS REFERENCE TO RELATED APPLICATION

This application is a national stage of PCT/EP02/02161 filed Feb. 28, 2002 and based upon DE 101 12 086.9 filed Mar. 12, 2001 under the International Convention.

BACKGROUND OF THE INVENTION

1. Field of the Invention

The invention relates to a distributor device for thick matter, especially for concrete. The distributor device comprises a concrete distributing boom carrying a conveying conduit, which has at least two boom arms that can be swiveled about horizontal articulation axes relative to one another or relative to a boom support, of which at least one of the boom arms is telescopically extendable and includes a static telescope part and a telescope part extendable relative to the static part, wherein the conveying conduit is assembled from multiple linked conduit sections, of which a first conduit section is preferably rigidly linked with the stationary member, while a second conduit section is rigidly linked with the extendible telescoping member, and wherein an intermediate piece adaptable to the extension of the telescoping part connects the first and second conduit sections.

2. Description of the Related Art

Distribution devices of this type are employed mainly for conveyance of concrete, for example for production of concrete decks in high-rises. The conveyance conduit extends along the boom arms and includes articulation connections in the area of the articulation axes and axially parallel thereto. In the area of the telescopic boom arm there is additionally a need for a length adapter for the conveyor conduit.

In a distribution device of the above described type it is known (U.S. Pat. No. 4,130,134) to provide a distribution boom for a mobile concrete pump with a telescopic base arm. The length adaptation of the conveyor conduit occurs therein by a scissors system comprised of three articulated conduit segments connected to each other. The conduit segments project sideways far beyond the telescopic boom arms during the telescoping process and represent thereby an impediment to boom movement. Beyond this, strict limitations or boundaries exist for the telescope hub of the thereby described telescope design on the basis of the scissors-like design of the conveyor conduit segment.

SUMMARY OF THE INVENTION

Beginning therewith, it is the task of the present invention to develop a distribution device for thick matter pumps, which can make possible with simple means a length adaptation of the conveyor conduit on a telescopic boom arm even in the case of a large telescope extension or stroke.

For solving this task, the combination of characteristics set forth in Patent claim 1 are proposed. Advantageous embodiments and further developments of the invention can be seen from the dependent claims.

The inventive solution is based upon the idea, that the intermediate segment adaptable to the telescope movement of the telescope part is in the form of a flexible hose connected with its ends to a first and a second conduit segment, which includes a 180° bend with constant curvature parallel to the direction of the telescope stroke. A hose of this type can be easily adapted to various telescope strokes or extensions by change of its length.

A preferred embodiment of the invention envisions that the flexible hose is partially supportable in a support wall or cradle rigidly connected with a fixed part, wherein the 180° bend projects beyond the support wall and wanders with its wall-side end along the support wall during telescoping. The support wall is preferably provided spaced apart from the fixed part. According to a further advantageous embodiment of the invention the fixed part besides this includes, spaced apart from the support wall, a convex support link or slider for supporting the 180° bend in the retracted condition of the telescope part. For further improvement of the hose guidance during telescoping the telescope part carries in the area of its interfacing with the fixed part an abutment link or slider extending over or about the outlet side end of the hose.

In accordance with a further advantageous embodiment of the invention it is envisioned that the first conduit segment includes a parallel part extending out from the bend linkage of the fixed part essentially parallel to the longitudinal extension thereof and a thereto connectable slanted part extending diagonally to the fixed telescope part until in the vicinity of the support wall, to the later of which the hose is connected with its parallel to the support wall oriented inlet. Further, there is proposed in accordance with the invention, that the second conduit segment includes a pipe running from the bend linkage of the telescope part out in essentially parallel to the telescope axis, to which the hose is connected with its outlet side facing in the inlet direction, and preferably via a 180° pipe curvature.

It is particularly advantageous when the base arm linked to the boom block rotatable about a vertical axis of the distribution boom is telescopic.

A particularly advantageous embodiment of the invention is comprised therein, that the distribution boom is provided upon a vehicle chassis of a mobile concrete pump, wherein the conveyance conduit is connected to the pressure outlet of a conveyor pump provided on the vehicle.

According to a further preferred embodiment of the invention it is envisioned that the distribution boom is linked with its telescopic base arm to a boom block rotatable 360° about a vehicle chassis fixed vertical axis and mounted on the vehicle chassis in the vicinity of the driver cabin, and that the separation between the rotation axes and the slanted part of the first guide segment corresponds to at least the distance between the rotation axes and the forward edge of the driver cabin. Thereby the possibility of a collision of the conveyor conduit with the driver cabin during telescoping of the base arm with horizontal pivoted-out distribution boom over the driver cabin is avoided.

The fixed part of the telescopic base arm is preferably longer than the subsequent boom arms of the distribution boom. With the inventive means it is possible that the telescopic base arm carries out a large telescopic extension. It has been found particularly advantageous when the telescopic base arm in the extended condition of the telescopic part is 1.6 to 3.5 times as long as the subsequent boom arms.

BRIEF DESCRIPTION OF THE DRAWINGS

In the following the invention will be described in greater detail on the basis of the figures. There is shown FIG. 1 a side view of a mobile concrete pump with three axle vehicle chassis and distribution boom with telescopic base arm in folded in-transport configuration and unfolded and telescoped working configuration.

DETAILED DESCRIPTION OF THE INVENTION

Figure 1:
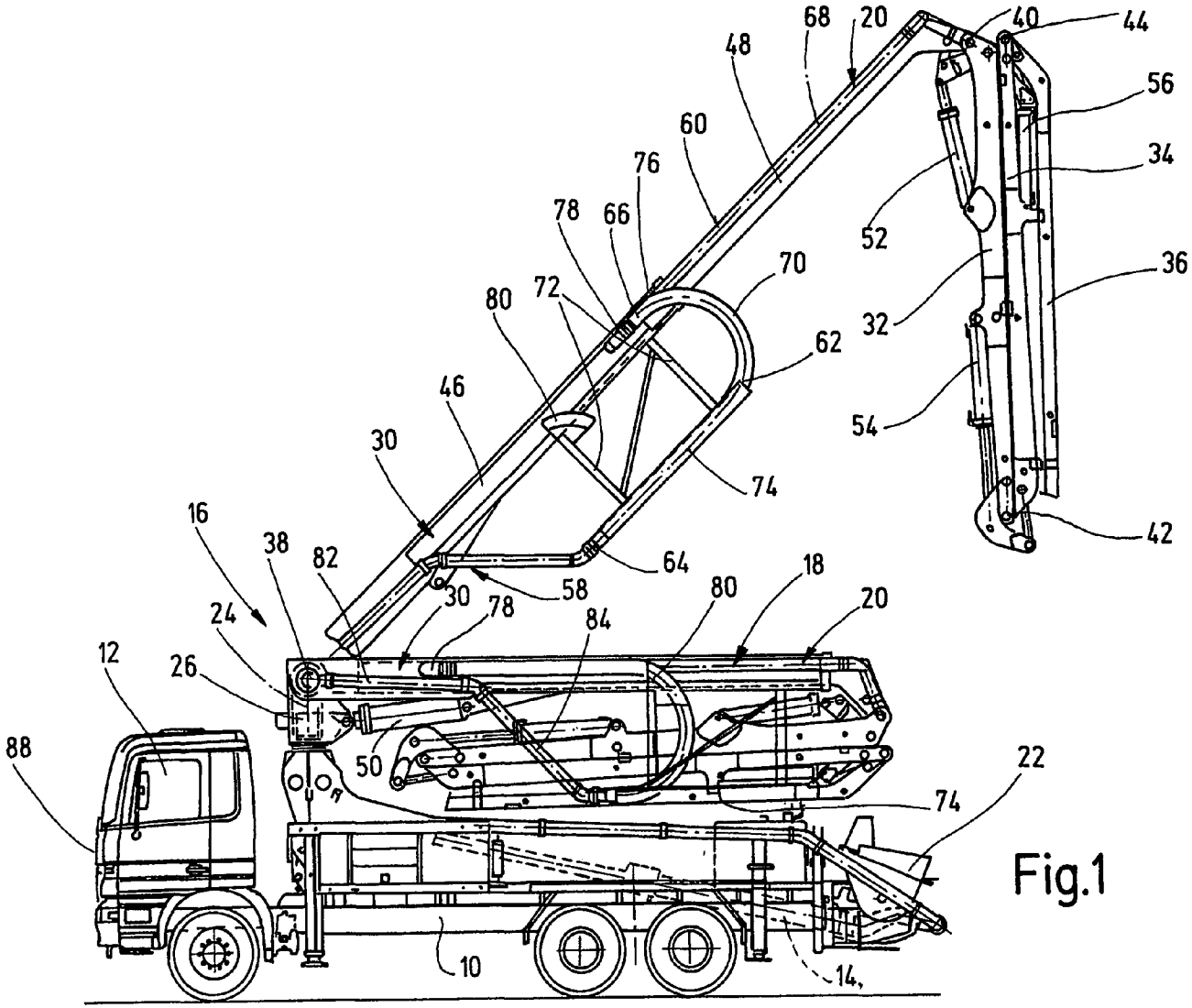

The mobile concrete pump shown in the figures includes a vehicle chassis 10 with a driver cabin 12, a thick matter pump 14 in the form of, for example, a two cylinder piston pump, as well as a distribution device 16, which includes a distribution boom 18 as carrier for a concrete conveyor line 20. Fluid concrete is conveyed along the concrete conveyance conduit, which is continuously introduced into a supply container 22 during concretizing and conveyed to a concretizing location located distant from the position of the vehicle 10.

The distribution device 16 includes a boom block 26 rotatable about a vehicle chassis-fixed vertical axis 24 by means of a hydraulic rotation drive, and a distribution boom 18 pivotable thereupon, which is adjustable to variable extension and height differences between the vehicle 10 and the concretizing location. The distribution boom 18 is comprised in the illustrated exemplary embodiments of four boom arms connected articulated with each other 30 through 36, which are pivotable about articulation axes 38 through 44 extending parallel to each other and perpendicular to the rotation axis 24 of the boom block 26. The base arm 30 linked to the boom block 26 in the area of the articulation axis 38 is, besides this, a telescoping arm comprised of a fixed part 46 and a extendable telescope part 48 aligned therewith. The articulation axes 38 through 44 and the telescope axes 68 are so coordinated relative to each other, that the distribution boom 28 in the case of retracted telescope part 48 and with multiple folding of the boom arms 30 through 36 is collapsible into a space-saving transport configuration upon the vehicle chassis 10. The distribution boom 18 can be unfolded to extend between the vehicle location and the concretizing location by activation of drive aggregates 50 through 56 in the form of hydraulic cylinders, which are associated with the articulation axes 38 through 44, as well as a not shown drive aggregate for the telescope part 48.

Figure 2:
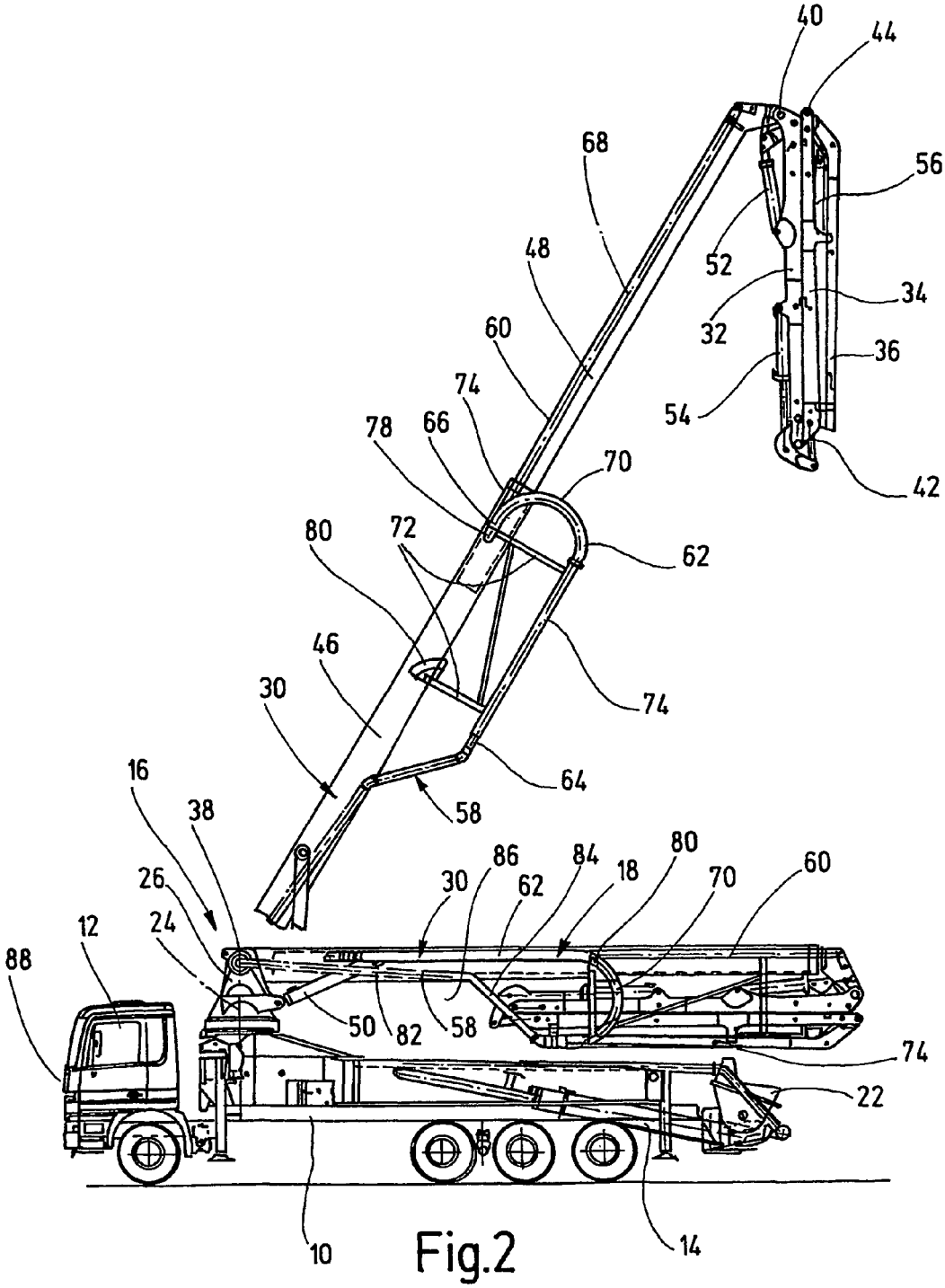
FIG. 2 a side view of a mobile concrete pump with four axle vehicle chassis and a representation according to FIG. 1.

One special feature of the distribution device 16 shown in FIGS. 1 and 2 is comprised therein, that the conveyor line 20 in the area of the telescopic boom arm 30 was an assembly of three conveyor segments connected with each other, of which a first conveyor segment 58 is rigidly connected with the fixed part 46 and a second conveyor segment 60 is rigidly connected with the telescope part 48, while the intermediate segment 62 is adaptable to the telescope movement of the telescope part 48. The intermediate segment 62 is in the form of a flexible relatively stiff hose, which with its inlet end 64 is connected to the output of the first conveyor segment 62 and with its output end 66 is connected to the input of the second conveyor segment 60. The hose 62 includes a 180° bend 70 of constant curvature which wanders or moves along during the telescope movement parallel to the telescope axis 68. In order to maintain a constant 180° curvature during telescoping, the hose 62 is partially supportable by a support wall 74 rigidly connected with the fixed part 46 via strut 72. The 180° bend wanders with its wall end along the support wall during telescoping and projects with the rest beyond the support wall. On one side of the extendable telescope part 48 there is additionally a fixture 46 extending over or about the output bend 66 of the hose 62. The hose 62 is there connected with its output end 66 via a 180° pipe curvature 78 to the input of the second conveyor segment 60. For stabilizing the hose 62 in the end position of the extendable telescope part 48 the fixed part 46 carries spaced apart from the support wall 74 a convex support linkage 80 for supporting the 180° bend 70.

A further particular feature is comprised therein, that the first conveyor segment 58 includes a longitudinal part running from the articulation axis 38 of the fixed part 46 outward and essentially parallel thereto and a thereto connected diagonal part 84, extending diagonally to the fixed telescopic part 48 until in the vicinity of the support wall 74, to which the hose 62 with its parallel to the support wall 74 oriented inlet end 64 is connected. By this means it is achieved that a free space 86 remains below the base arm 30, which makes it possible to rotate the distribution boom with horizontal oriented base arm 30 over the driver cabin 12 without danger of collision. For this purpose the distance between the rotation axes 24 of the boom block 26 and the slanted part 84 corresponds at least to the distance between the rotation axes 24 and the forward edge 88 of the driver cabin 12. In the embodiments shown in FIGS. 1 and 2 the fixed part 46 of the telescopic base arm 30 is longer than the subsequent boom arms 32 through 36. In the extended condition the telescopic base arm upon utilization of the full telescope stroke or length is in the case of FIG. 1 approximately 1.7 times as long as the subsequent boom arms. In the case of FIG. 2 the extended base arm is even 2.5 times as long as the subsequent boom arms.

The described mobile concrete pumps are particularly suited for movement under ceilings in high rises, wherein the telescopic base arm 30 essentially contributes thereto that the distribution device 16 is adaptable from the location of the vehicle 10 out to a predetermined floor. By the use of a hose 60 with 180° bend 70 a concrete pump builder is provided with a construction principle that is adaptable to any telescope stroke. He need essentially merely select an appropriate hose length.

In summary the following can be concluded: The invention concerns a distributor device for thick matter, especially for concrete. The distributor device 16 comprises a concrete distributing boom 18 carrying a conveying conduit 20, which has at least two boom arms 30 to 36 that can be swiveled about horizontal articulation axes 38 to 44 relative to one another or relative to a boom support 26. At least one of the boom arms, preferably the base arm 30, is telescopically movable. In order to be adaptable to the telescoping movements, the conveying conduit is assembled from three interlinked conduit sections in the area of the telescoping boom arm. A first conduit section 58 is rigidly linked with the stationary member 46, while a second conduit section 60 is rigidly linked with the extensible telescoping member 48. The device further comprises an intermediate section 62 which is connected with its ends 64, 66 to the first and the second conduit section 58, 60 and which is configured as a flexible pipe. Said pipe has a 180° arch 70 with constant curvature that travels when the boom arm telescopes.

What is claimed is:

1. A distribution device for thick matter, including a distribution boom (18) carrying a conveying conduit (20), which has at least two boom arms (30 to 36) that can be swiveled about horizontal articulation axes (38 to 44) relative to one another or relative to a boom support (26), of which at least one of the boom arms (30) is telescopic and includes a static part (46) and a therewith aligned and relative thereto extendable telescope part (48), wherein the conveying conduit (20) is comprised of multiple interconnected conduit sections (58 to 62) in the area of the telescoping boom arm, of which a first conduit section (58) is rigidly connected with the static part (46), a second conduit section (60) is rigidly connected with the extendable telescope part (48), and an intermediate section (62) is provided which connects the first and the second conduit sections, wherein the intermediate section (62) is a flexible pipe, including a 180° bend (70) with constant curvature that travels as the boom arm telescopes.

2. A distribution device according to claim 1, wherein the flexible pipe is partially supportable against a support wall (74) rigidly connected with the static part (46).

3. A distribution device according to claim 2, wherein the flexible pipe projects with its 180° bend (70) beyond the support wall (74).

4. A distribution device according to claim 2, wherein the 180° bend (70) wanders with its wall end along the support wall (74) during telescoping.

5. A distribution device according to claim 2, wherein the support wall (74) is provided spaced apart from the static part (46).

6. A distribution device according to claim 2, wherein the static part (46) includes a convex support element spaced apart from the support wall (74) for supporting the 180° bend in the retracted configuration of the extendable telescope part (48).

7. A distribution device according to claim 2, wherein the first conduit section (58) includes a longitudinal part (82) running from the articulation axis (38) of the static part (46) out essentially parallel to the longitudinal direction thereof and a slanted part (84) connected thereto extending diagonally to the static part (46) until the vicinity of the support wall (74), to which the flexible pipe is connected with its inlet end (64) oriented parallel to the support wall (74).

8. A distribution device according to claim 1, wherein a second conveyor segment (60) includes a pipe running from a articulation linkage (40) of the extendable telescope part (48) essentially parallel to the second conveyor segment (60), to which the flexible pipe is connected with its retraction direction facing end (66), via a 180° curved pipe (78).

9. A distribution device according to claim 1, wherein the extendable telescope part (48), in the vicinity of its end facing the static part (46), carries an abutment linkage (76) extending over or about the outlet end (66) of the hose.

10. A distribution device according to claim 1, wherein the boom arm (30) which is at the base of the distribution boom (28), and which is linked to the boom block (26), which boom block (26) is rotatable about a vehicle chassis-fixed vertical axis (24), is telescopic.

11. A distribution device according to claim 1, wherein the distribution boom (18) is provided upon a vehicle chassis (10) of a mobile concrete pump, wherein the conveying conduit (20) is connected to the pressure output of a vehicle chassis (10) associated conveyor pump (14).

12. A distribution device according to claim 10, wherein the distribution boom (18) with its telescopic base boom arm (30) is linked to a boom block (26) provided in the vicinity of a driver cabin (12) and rotatable 360° about a vehicle chassis-fixed vertical axis (24), and wherein the distance between the rotation axis (24) of the boom block (26) and a slanted part (84) of the first conduit segment (58) corresponds to at least the distance between the rotation axes (24) and a front edge (88) of the driver cabin (12).

13. A distribution device according to claim 1, wherein the fixed part (46) of the telescopic base arm (30) is longer than the boom arms (32 through 36) of the distribution boom (18).

14. A distribution device according to claim 10, wherein the distribution boom (18) comprises a telescopic base arm (30) and subsequent boom arms (32 through 36), and wherein telescopic base arm (30) when extended is 1.6 to 3.5 times as long as the subsequent boom arms (32 through 36).

* * * * *